United States Patent [19]

Evans

[11] 4,245,644

[45] Jan. 20, 1981

[54] BREAST PROSTHESIS OR AUGMENTING FORM INCLUDING SPRING-MASS SYSTEM

[76] Inventor: Robert F. Evans, 631 Honeywood La., La Habra, Calif. 90631

[21] Appl. No.: 937,402

[22] Filed: Aug. 28, 1978

[51] Int. Cl.[3] ..... A41C 1/14; A41C 3/10; A61F 1/00

[52] U.S. Cl. ..... 128/476; 128/479; 3/36

[58] Field of Search ..... 128/462, 437, 479, 480, 128/481, 466, 478, 488; 3/36

[56] References Cited

U.S. PATENT DOCUMENTS

| | | | |
|---|---|---|---|
| 3,285,247 | 11/1966 | Morin | 128/479 |
| 4,024,876 | 5/1977 | Penrock | 128/472 |
| 4,125,117 | 11/1978 | Lee | 128/481 |

*Primary Examiner*—Doris L. Troutman
*Attorney, Agent, or Firm*—John R. Ley

[57] ABSTRACT

A breast prosthesis or augmenting form for use in a breast cup of a brassiere-like woman's undergarment includes a spring-mass system. The spring-mass system includes a mass member forwardly positioned from the chest of the wearer by a resilient cantilever spring support means. The resilient cantilever spring support means is arranged to effectively absorb, store and transmit energy in quantities generally comparable to that available in the chest area due to natural body movement. The spring support means may include a spring wire arrangement or an elastomer resilient base material. The spring-mass system can also be employed in a conventional brassiere to enhance natural breast movement.

15 Claims, 5 Drawing Figures

BREAST PROSTHESIS OR AUGMENTING FORM INCLUDING SPRING-MASS SYSTEM

BACKGROUND OF THE INVENTION

1. Field of the Invention

This invention relates to women's undergarments, and more particularly, to a new and more improved brassiere or breast prosthesis or augmenting form including a spring-mass system useful for enhancing the appearance and natural effects of an artificial form contained within the brassiere or for enhancing natural movement effects of natural breasts.

2. Brief Description of Prior Arts

Breast prosthesis or augmenting forms are well-known. Such devices are chiefly used after surgery or for augmenting what may be considered inadequate natural endowment. In both situations, the acceptance by the wearer of the device is directly related to its effectiveness in simulating a natural breast. In situations of mastectomy, dependence on the prosthesis is complete, and, therefore, it is very important that the prosthesis simulate the effects of natural breasts as completely as possible.

Prior art prosthesis are of questionable effectiveness and acceptance. Most prior art prosthesis or augmenting forms are formed as a lightweight pillow-like pad of fibrous or foamed material. After use, such devices begin to loose shape and form. The lightweight construction results in almost no movement of the prosthesis similar to that natural movement which occurs with a natural breast due to human body movement.

One effect contributing an inanimate and lifeless appearance of prior art prosthesis has been the loss of natural movement or the inability to simulate such natural movement. One prior art attempt to simulate natural movement is a fluid bladder device contained within the breast cup of a special brassiere. Such devices have only met with limited acceptance and success in attempting to simulate natural movement.

In certain limited situations not involving breast prosthesis or augmenting forms, it may prove desirable to increase or enhance the natural movement of natural breasts.

Other considerations and factors are known to those skilled in the art. Certain of these considerations may be more readily comprehended in view of the substantive features and advantages obtained by the present invention.

THE INVENTION

1. Objectives

The general objective of the invention is to provide a breast prosthesis or augmenting form which secures significant advancements and improvements over previous devices in the art. The major objective is to eliminate the inanimate and lifeless appearance of previous breast prosthesis. Another objective is to absorb, store and release kinetic energy in a prosthesis or augmenting form in quantities generally comparable to similar energy effects of a natural breast, so as to induce natural and lifelike effects in the prosthesis as a result of natural body movement. Another objective is to increase energy storage and reduce the energy dissipation in a breast prosthesis. One further object is to provide an arrangement for use with a conventional brassiere for enhancing the movement of a conventional prosthesis or for enhancing the movement of natural breasts.

Other advantages, features and objectives are apparent to those skilled in the art.

2. Summary

In accordance with these and other objects, the present invention comprises a breast prosthesis or augmenting form including a spring-mass system. The prosthesis is adapted to be received within or formed as a part of a brassiere breast cup. Spring means of the spring-mass system primarily support an added mass at a position spaced from the chest of the user and preferably at the apical portion of the breast cup. The spring means is arranged as a cantilever beam for effectively absorbing, storing and releasing energy available in the chest area as movement of the prosthesis. The spring means of the spring-mass system may take the form of a spring wire member having a base portion positioned adjacent the chest, a forward projecting cantilever spring portion and a hinge portion resiliently holding the spring portion in a cantilevered position. The spring means may also comprise a resilient foam elastomer material which positions the added mass and acts as a cantilever spring support.

A more complete understanding of the invention can be obtained from the drawings described next and from the description of the preferred embodiment.

DESCRIPTION OF PREFERRED EMBODIMENTS

Figure 1:
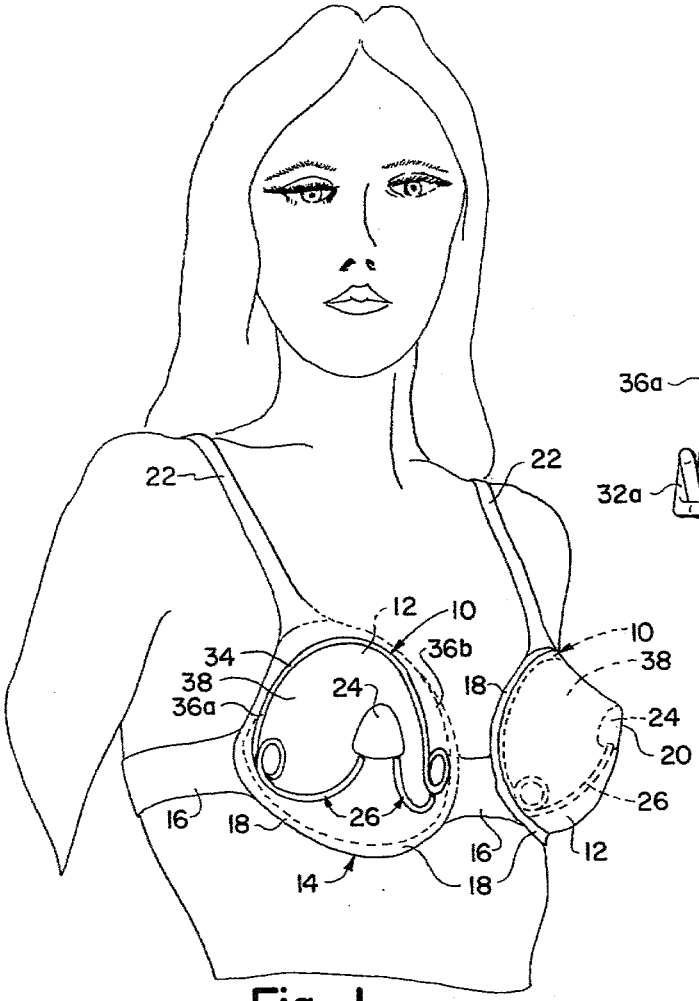
FIG. 1 is a perspective view of one embodiment of a brassiere incorporating the present invention, illustrated as worn and with an outer layer of material removed from one breast cup to reveal a breast prosthesis or breast augmenting form including one embodiment of a spring-mass system of the present invention.

One breast prosthesis 10 or breast augmenting form is shown generally in FIG. 1 as received within each breast cup 12 of a brassiere 14. The prosthesis 10 may be constructed as an integral part of a special brassiere, or the prosthesis may be constructed separately for insertion into the breast cup of a conventional brassiere. Details of the preferred embodiment will be described using references relative to the typical manner in which the brassiere is worn, as shown in FIG. 1. As used, "forward" means in the direction in front of the individual and "upward" means toward the head of the individual. "Rearward" and "downward" are respectively opposite in direction from "forward" and "upward". "Transverse" means in the direction between the shoulders of the individual. Formatives or similar terms of these terms have similar meanings.

The brassiere 14 will typically take the form of a separate woman's undergarment as shown. However, brassiere like arrangements integrated into woman's outer wear are also within the contemplation of the invention. The brassiere includes two breast cups 12 attached to a supporting band 16. The supporting band 16 encircles the chest of the wearer in a curved contour flat against the chest as shown, but other band arrangements may contact only the front of the chest in the area adjacent the breast cups 12. The cups 12 are attached to the band 16 at the curved rearward marginal area 18 or junction of the cup with the band. The cup extends forward from the attachment area 18 in a rearwardly concave manner to its forward most apical portion 20. The breast cup thus defines an interior volume into which the prosthesis 10 is received. Optional shoulder straps 22 extend from the top of the cups over the shoulders of the wearer and connect with the band 16 in the back. With the exception of the following matters noted, the brassiere is constructed in a conventional manner.

Figure 2:
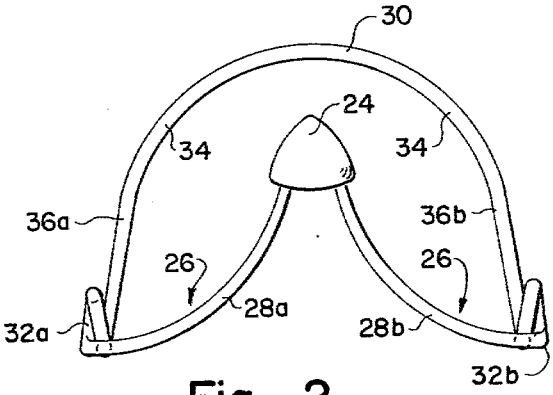
FIG. 2 is an elevational view of the spring-mass system illustrated in FIG. 1 removed from the brassiere, viewed from the front of the breast cup toward the rear.
Figure 3:
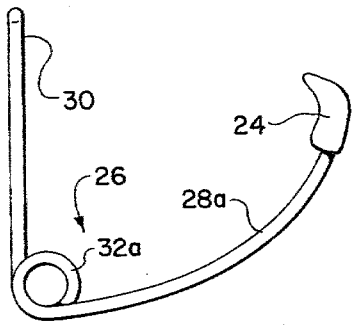
FIG. 3 is a side view of FIG. 2.

Each prosthesis 10 is formed with a spring-mass system in accordance with the invention. One embodiment of a spring-mass system is illustrated in FIGS. 1–3. The spring-mass system includes a mass member 24 spaced significantly forward from the band 16 and the chest of the wearer. Preferably, the mass member 24 is positioned generally in the vicinity of the apical portion 20 of the cup 12, typically within the interior of the cup. The size of the mass member 24 is less than one-half the interior volume of the cup, and its mass density is greater than the mass density of the material filling the majority of the remainder of the interior volume of the cup. The forward facing surface of the mass member can be formed in any configuration to simulate any desired effect. Ordinarily, the mass member is constructed from metallic materials such as lead or steel, but can also be constructed of any suitable high mass density non-metallic material so as to allow passage through airport metal detectors, for example.

The spring-mass system of the prosthesis also includes spring means operatively positioning the mass member 24 within the cup, preferably at the apical portion 20. The spring means may take one of several embodiments described below. In each embodiment the spring means extends forward from adjacent the band 16 and the chest of the wearer and connects to the mass member 24. The spring means, by virtue of its characteristics and connection to the mass member 24, defines a resilient forward projecting support having cantilever energy transferring characteristics capable of absorbing, storing and releasing kinetic energy in quantities generally comparable to that energy available at the breast area of the wearer due to natural human body movement, such as walking, etc. So as to avoid unduly dissipating the energy available from this energy transferring characteristic, the breast cup 12 may be formed in substantial part from elastic fiber material of low energy damping characteristics.

A spring wire member 26, shown in FIGS. 1–3, forms one embodiment of the spring means. The spring wire member 24 includes two forwardly projecting and transversely spaced spring members or portions **28*a* and 28*b*, a base member or portion 30 formed in a U-shaped configuration, and two resilient spring hinge portions 32*a* and 32*b* formed as coils in the spring wire member 26. The spring wire member 26 is preferably sewn or otherwise suitably attached with the interior of the breast cup 12. The spring wire member may be formed as a part of a separate prosthesis, or may be sewn or otherwise suitably attached within the interior of the cup 12. When attached to the interior of the cup, the cup will preferably be of the padded variety and the spring wire member 26 and mass member 24** will be concealed within the padded walls of the cup.

When properly received within the cup, the base portion 30 is held in supported relation adjacent the chest of the wearer. The U-shaped base portion 30 may be suitably stiched in the marginal area 18 where the cup 12 is attached to the band 16. As shown in FIGS. 1 and 2, an upper curved segment 34 of the base portion generally follows the upper curved marginal area of the cup. Two side segments **36*a* and 36*b* depend downwardly from the curved segment 24 on opposite transverse sides of the cup. The spring hinge coils 32*a* and 32*b* respectively connect the rearward ends of the spring portions 28*a* and 28*b* to the side segments 36*a* and 36*b*. The base portion 30 and the spring hinge coils 32*a* and 32*b* thus define one example of means operatively connecting the rearward end of the spring portions 28*a* and 28*b* to the brassiere 14 at the rearward area of the cup to allow the spring portions 28*a* and 28*b*** to react to energy absorption and storage in a manner generally characteristic of a cantilever beam.

The spring portions **28*a* and 28*b* extend at a relative angle with respect to the base portion 30 of greater than 0 degrees and less than 180 degrees. The spring portions preferably curve upward in a forward converging manner to the mass member 24, where the forward ends of the spring portions are rigidly attached to or embedded in the mass member 24. The spring portions are preferably positioned at the bottom curve of the cup and are curved upwardly in the manner of natural breast curvature. Positioned at the bottom curve of the cup, the spring portions support material filling the remainder of the cup volume not occupied by the mass member 24**.

Filler material 38 occupies the remainder of the volume of the cup. Thus the filler material occupies greater than one-half the interior volume of the cup. The material 38 has a mass density less than the mass density of the mass member 24. The filler material extends from an area or surface adjacent the chest to the mass member, and the filler material may be bonded to the mass member and spring wire member 26. The filler material 28 is preferably a foamed elastomer material. The foamed elastomer material avoids dissipating or damping all of the available kinetic energy while still providing firm but flexible support structure. Of course, if the spring wire member-mass system described above is utilized in a conventional brassiere for natural breasts without augmentation or prosthesis, no filler material is required.

Figure 4:
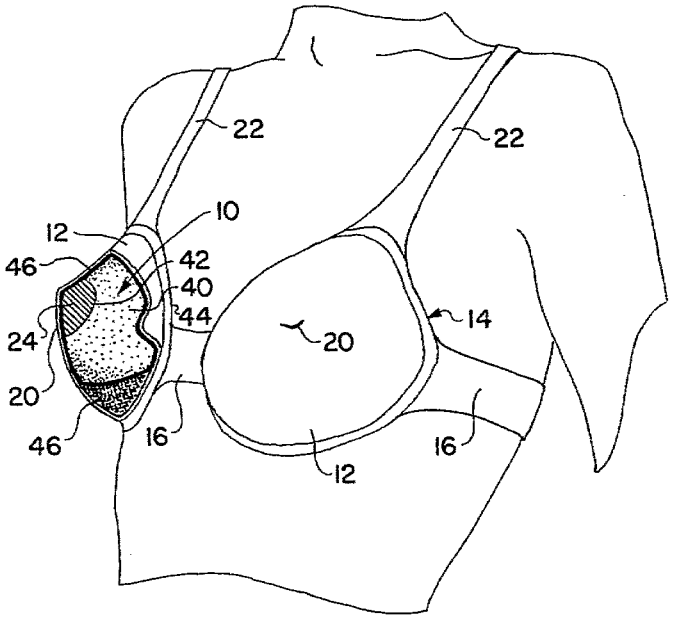
FIG. 4 is a perspective view of a brassiere illustrated as worn and with a side elevational section view through one of the breast cups to illustrate one embodiment of a prosthesis or breast augmenting form of the present invention including another embodiment of the spring-mass system of the present invention.
Figure 5:
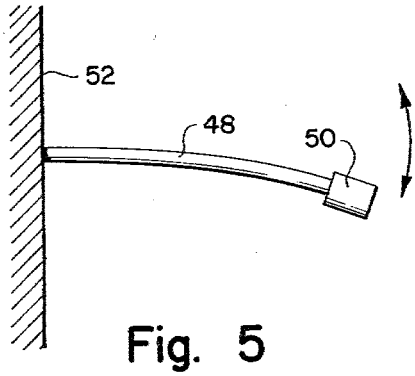
FIG. 5 is a schematic view of a cantilever beam stationarily fixed at one end and with a mass added at the other end, which may be considered as a mechanical equivalent of the spring-mass system involved in the present invention for illustrative and descriptive purposes.

Another embodiment of the spring means of the spring-mass system is shown in FIG. 4. In this embodiment a base support material 40 serves as the spring means of the spring-mass system. The base material 40 possesses elastic and resilient characteristics and operatively positions the mass member 24 at the apical position 20 or at an other position substantially forwardly spaced from the band 16. The mass member 24 is connected at a forward surface 42 of the base material, as by bonding. The remaining volume of the cup 12 is wholly occupied by material 40 and a rearward surface 44 is held in operative firm supported engagement with the chest of the user by the brassiere 14. The rear surface 44 is appropriately contoured for this purpose. The filler material 40 occupies greater than one-half the volume of the cup interior. In a complete breast prosthesis, the forward distance between the surfaces 42 and 44 is more than one-half the distance forward from the surface 44 to the apical portion 20. The base material 40 possesses a mass density less than the mass density of the mass member 24. Preferably, the base supporting material 40 is a foamed elastomer.

While the foregoing description has related primarily to a prosthesis formed as a brassiere, it should be recognized that the breast prosthesis 10 or augmenting form can be constructed separately of the brassiere. The separate prosthesis can then be inserted into and worn in the cup of a conventional brassiere. The separate prosthesis is formed with a spring-mass system as previously described in one of the foregoing embodiments, and in addition, includes an outer elastic cover 46, shown in FIG. 4. The outer surface of the elastic cover 46 essentially has the same shape and contour as the shape and contour of the interior of the breast cup 12 shown, i.e., a shape similar to a natural breast. The elastic cover 46 defines an interior volume similar in shape and comparable in size to the interior volume of the breast cup. The cover extends over and encompasses the mass member 24 at the apical end of the separate prosthesis and defines a rearward surface similar to the surface 44 operatively supported against the chest of the wearer.

It should also be recognized that the spring wire member-mass system shown in FIGS. 1 and 3 can be inserted in a separate prosthesis. In addition, the spring wire member-mass system can also be worn in the breast cup of a conventional brassiere for the purpose of enhancing natural movement effects of natural breasts.

Operation of the spring mass system can best be analogized to an equivalent cantilever beam 48 with a mass 50 added at the free end of the beam and with the other end of the beam rigidly connected to a stationary object 52. By calculus, it can be demonstrated that adding mass at the terminal free end of the beam is 4.24 times as effective in transferring kinetic energy than if the same mass is distributed over the total length of the beam. Expressed in terms directly applicable to the invention, adding mass to the apical end has the effect, from an energy transferring standpoint, of moving the center of mass of a prosthesis outward. Moving the center of mass forward makes the prosthesis significantly more susceptable to movement resulting from energy available from natural body movement. The added terminal mass effect can be better understood with respect to the cantilever analogy by reference to An Introduction to Mechanical Vibrations by Robert F. Steidel, Jr., John Wiley & Sons, Inc., 1971, pages 80–81.

The cantilever spring-mass system is distinguishable from prior art breast prosthesis and augmenting forms. The typical prior art prosthesis is formed of uniform density material, typically a lightweight foam or fibrous material. The uniform density material keeps the center of mass very close to the chest of the wearer, thus unduly inhibiting motion and energy transferring characteristics. The lack of natural movement characteristics is, of course, a major contributing cause to the lifeless, inanimate appearance of prior art prosthesis. Furthermore, use of cantilever springs as energy transferring means between the chest of the wearer and the forwardly spaced mass has not previously been recognized as significantly contributing to a remedy for the problem of lifeless appearing prosthesis and augmenting forms.

In common terms, the spring-mass cantilever system of the present invention induces more movement into breast prosthesis or augmenting forms than as previously been available. The effective result is that the prosthesis loses its lifeless and inanimate appearance and takes on the exterior appearance through movement and the like of a natural breast. The movement of natural breasts is also enhanced because of the effect of moving the center of mass of the breast outward, thus increasing overall movement. It is, therefore, apparent that a significantly new and improved breast prosthesis or augmenting form has been provided which achieves significant advantages and benefit over previously available comparable devices.

Preferred embodiments of the present invention have been shown and described with a degree of particularity. It should be understood that the specificity of the present disclosure has been made by way of example and that changes may be made without departing from the scope of the invention.

What is claimed is:

1. In a brassiere having a supporting band and at least one breast cup attached to and extending forward from the band, an improvement comprising:

a mass member of volumetric size less than the interior volume of the cup positioned generally spaced significantly forward from the band and chest of the wearer within the cup, said mass member being of mass density greater than the density of the material filling the remainder of the volume of the cup; and spring means positioned within the cup and extending from adjacent to the band and chest forward to and connecting with said mass member, said spring means effectively defining a resilient forwad projecting support having cantilever energy transferring characteristics for operatively connecting the mass member forwardly spaced from the band, said spring means having characteristics of absorbing, storing and releasing kinetic energy operatively between the chest of the user and the mass member in quantities generally comparable to that energy available at the breast area due to natural body movement.

2. An invention as recited in claim 1 wherein said mass member is positioned by said spring means generally in the vicinity limited by the curved apical portion of the cup.

3. In a brassiere having a supporting band and at least one breast cup attached to and extending forward from the band, an improvement comprising:

a mass member of volumetric size less than the interior volume of the cup positioned generally spaced significantly forward from the band and chest of the wearer within the cup, said mass member being of mass density greater than the density of the material filling the remainder of the volume of the cup; and spring means positioned within the cup and extending from adjacent to the band and chest forward to and connecting with said mass member, said spring means effectively defining a resilient forward projecting support for said mass member, said spring means comprising:

(a) at least one elongated spring member projecting forwardly from adjacent the band to the mass member, the forward end of the spring member rigidly connected to the mass member, and the rearward end of the spring member being positioned adjacent the band; and (b) means operatively and sufficiently connecting the rearward end of said spring member to the brassiere at the rearward area of the cup to allow the spring member to react to kinetic energy absorption, storage and release in a manner generally characteristic of a cantilever support element.

4. An invention as recited in claim 3 wherein said connection means comprises:

a base member extending at an angle of between greater than 0 degrees and less than 180 degrees with respect to the spring member, and the base member extending essentially parallel to the contour of the band in the marginal area generally adjacent the cup; and a spring hinge operatively resiliently and elastically connecting the rearward end of the spring member to the base member.

5. An invention as recited in claim 4 wherein said brassiere further includes means associated with the cup and band for holding the base member in supporting relation on the chest of the wearer.

6. In a brassiere having a supporting band and at least one breast cup attached to and extending forward from the band, an improvement comprising:

a mass member of volumetric size less than the interior volume of the cup positioned generally spaced significantly forward from the band and chest of the wearer within the cup, said mass member being of mass density greater than the density of the material filling the remainder of the volume of the cup; and spring means positioned within the cup and extending from adjacent to the band and chest forward to and connecting with said mass member, said spring means effectively defining a resilient forward projecting support for said mass member, said spring means comprising a spring wire member positioned essentially by the cup, said spring wire member comprising:

(a) a base portion extending essentially parallel to the chest contacting contour of the band in the marginal area adjoining the junction of the cup and the band;

(b) an elongated forward projecting portion connected at its forwardmost end to the mass member and operatively resiliently connected at its rearwardmost end to the base portion; and (c) a spring hinge portion operatively resiliently connecting the rearwardmost end of the forward projecting portion to the base portion.

7. An invention as recited in claim 6:

wherein the base portion of the spring wire member is generally of U-shaped configuration, the U-shaped configuration having an upper curved segment adapted to be positioned generally adjacent to the curved marginal edge of the cup, the U-shaped configuration also having side segments depending from the curved portion on opposite transverse sides of the cup;

further comprising a second elongated forward projection portion of the spring wire member in addition to the forward projection portion first aforementioned, said second forward projection portion having similar characteristics to the first forward projection portion, the forwardmost end of the second projection portion also being rigidly connected to the mass member, the rearwardmost end of the first projection portion being operatively connected to the side segment of the U-shaped base portion on one transverse side of the cup, and the rearwardmost end of the second projection portion being operatively being connected to the side segment of the U-shaped base portion on the other transverse side of the cup; and further comprising a second spring hinge portion of the spring wire member in addition to the spring hinge portion first aforementioned, the first spring hinge portion operatively connecting the rearwardmost end of the first projection portion to one side segment of the U-shaped base portion, and the second spring hinge portion operatively connecting the rearwardmost end of the second projection portion to the other transversely opposite side segment of the U-shaped base portion.

8. An invention as recited in claim 7 wherein:

the first and second spring hinge portions each comprise at least one coil formed in the spring wire member between the rearwardmost end of each projection portion and the side segment of the U-shaped base portion.

9. An invention as recited in claim 7 wherein said spring wire member and the mass member are attached to the cup.

10. An invention as recited in claim 2 further comprising:

resilient filler material received within the remainder of the volume of the cup, said filler material occupying greater than one-half the interior volume of said cup and having a mass density less than the mass density of the mass member.

11. An invention as recited in claim 1 wherein said spring means comprises:

a base support material of elastic characteristics received within and occupying substantially the whole of the remainder of the volume of the cup, said base support connecting to said mass member at the forward spaced position, said base support material having a rearward surface adapted to be operatively firmly supported against the chest of the wearer, said base support material having a mass density less than the mass density of said mass member and also having a volumetric size greater than the volumetric size of the mass member.

12. An invention as recited in claim 2 wherein said spring means comprises:

a base support material of elastic characteristics received within and occupying substantially the whole of the remainder of the volume of the cup, said base support material having a mass density of less than the mass density of said mass member, said base support material having a volumetric size greater than the volumetric size of the mass member, said base support material having a forward surface connected to the mass member and a rearward surface adapted to be firmly operatively supported against the chest of the user, the forward distance between the forward and rearward surfaces of said base support being greater than one-half the forward distance between the rearward surface of the base support and the apical portion of the cup.

13. A breast prosthesis or breast augmenting form for use with a brassiere-like device having a supporting band for contacting and extending along the chest of the wearer and also having a breast cup attached to the band, said prosthesis or augmenting form being adapted to be received within the breast cup, said prosthesis or augmenting form comprising:

an outer elastic cover defining an interior volume and having a forward projecting shape similar to a natural breast and a rearward surface adapted to be placed in adjacent supporting relation with the chest of the wearer, said elastic cover adapted to be received within the breast cup of the brassiere-like device;

a mass member of size less than the interior volume of said elastic cover and positioned generally in the vicinity limited by the curved apical portion of the cover, said mass member being of mass density greater than the mass density of the elastic cover or the average of the material filling the remainder of the interior volume of the cover; and spring means extending forward from the rearward surface of said elastic cover and connecting to the mass member, said spring means effectively defining a resilient forward projecting support having a cantilever energy transferring characteristics for operatively connecting the mass member forwardly spaced from the rear surface of the elastic cover, said spring means further comprising resilient elastic support material filling and occupying substantially the whole of the remaining volume of the elastic cover, said resilient elastic support material comprising at least one-half the interior volume of said elastic cover.

14. A breast prosthesis or breast augmenting form for use with a brassiere-like device having a supporting band for contacting and extending along the chest of the wearer and also having a breast cup attached to the band, said prosthesis or augmenting form adapted to be received within the breast cup, said prosthesis or augmenting form comprising:

an outer cover defining an interior volume having a forward projecting shape similar to a natural breast and a rearward surface adapted to be placed in adjacent supporting relation with the chest of the wearer, said cover adapted to be received within the breast cup;

a mass member of size less than the interior volume of said cover and of mass density greater than the mass density of any other material substantially occupying the interior volume of said cover, said mass member also of mass density greater than the mass density of any other material forming a substantial part of the prosthesis or augmenting form or of any other material forming a substantial part of the cup of the brassiere-like device; and resilient support means connected to the mass member for operatively positioning the mass member within the interior volume of the cover and at a forwardly spaced position from the rearward surface of the cover and from the band and chest of the wearer, said resilient support means operatively defining a cantilever support arrangement between the mass member and the chest of the wearer which possesses characteristics for absorbing, storing and releasing kinetic energy in quantities generally comparable to that energy available at the breast due to natural body movement.

15. An invention as recited in claim 14 wherein said mass member is positioned by said spring means generally in the vicinity limited by the curved apical portion of the cup.

* * * * *